United States Patent [19]

Mills

[11] Patent Number: 4,949,902

[45] Date of Patent: Aug. 21, 1990

[54] BUILDING HEATING SYSTEM

[76] Inventor: Charles W. Mills, 21011 Oak Ridge Rd., Sheridan, Ind. 46069

[21] Appl. No.: 459,516

[22] Filed: Jan. 2, 1990

[51] Int. Cl.[5] ..... F24F 7/00

[52] U.S. Cl. ..... 236/49.3; 126/422; 165/22

[58] Field of Search ..... 236/49.3; 165/22; 126/422, 428; 98/42.04, 31.5

[56] References Cited

U.S. PATENT DOCUMENTS 4,125,222 11/1978 Briscoe ..... 126/422
4,394,957 7/1983 Newton, III ..... 236/49.3
4,394,958 7/1983 Whitney ..... 236/49.3
4,628,798 12/1986 Tagnon ..... 98/31.6
4,681,024 7/1987 Ivey ..... 98/34.6
4,750,673 6/1988 Brunig ..... 237/50

*Primary Examiner*—William E. Wayner
*Attorney, Agent, or Firm*—T. M. Gernstein

[57] ABSTRACT

A building heating system includes a plurality of intake ducts located at various spaced apart locations in an attic as well as temperature sensors and a control circuit. The system has the intake duct located closest to the highest temperature air in the attic operated to draw air into the system.

5 Claims, 4 Drawing Sheets

BUILDING HEATING SYSTEM

TECHNICAL FIELD OF THE INVENTION

The present invention relates to the general art of fluid handling, and to the particular field of building heating systems.

BACKGROUND OF THE INVENTION

Many buildings include attic areas which often become quite hot when sunlight is incident on the roof of the building. Such buildings often include insulation to prevent heat transfer between the attic and the rest of the building. The attic thus, at best, becomes simply another room, and, at worse, becomes a heat sink that wastes energy.

The art thus contains several examples of systems intended to take advantage of the heat collection characteristics of a building attic.

While successful in using at least a portion of the heat energy collected in an attic, the presently-available systems are often not fully successful because they do not account for temperature gradients and temperature variations which occur in an attic. For example, one portion of the attic may be hotter than other portions during morning hours, and another portion may be hottest during the afternoon hours. In fact, the exact portion of the attic that is hottest may even vary within the same time period depending on the time of year. Operating a single system at all times, no matter what the precise conditions in the attic are, may be inefficient as well as wasteful of energy.

Therefore, there is a need for a building heating system that uses heat energy located in the attic area of the building in an efficient manner by accounting for temperature variations in the attic and moving only that air having the highest temperature from the attic into the building.

OBJECTS OF THE INVENTION

It is a main object of the present invention to provide a building heating system that uses heat energy located in the attic area of the building in an efficient manner.

It is a main object of the present invention to provide a building heating system that uses heat energy located in the attic area of the building in an efficient manner by accounting for temperature variations in the attic.

It is another object of the present invention to building heating system that uses heat energy located in the attic area of the building in an efficient manner by accounting for temperature variations in the attic and moving only that air having the highest temperature from the attic into the building.

SUMMARY OF THE INVENTION

These, and other, objects are achieved by a building heating system which includes a plurality of intake ducts that are located at speced apart locations throughout the attic of that building. Each intake duct includes a fan and an air flow control valve and has a thermocouple associated therewith. The thermocouoples are all connected to a comparator circuit that activates the fan and flow control valve in only that intake duct associated with the highest temperature in the attic. A base reference temperature is manually set using a control located in the building so that none of the inlet ducts will be activated if the highest temperature in the attic is below a preset temperature.

In this manner, as temperature conditions in the attic change, due to changing environmental ambient conditions, or the like, the overall building heating system can be altered to take maximum advantage of the heat energy that is located in the attic.

BRIEF DESCRIPTION OF THE DRAWING FIGURES

DETAILED DESCRIPTION OF THE PREFERRED EMBODIMENT OF THE INVENTION

Figure 1:
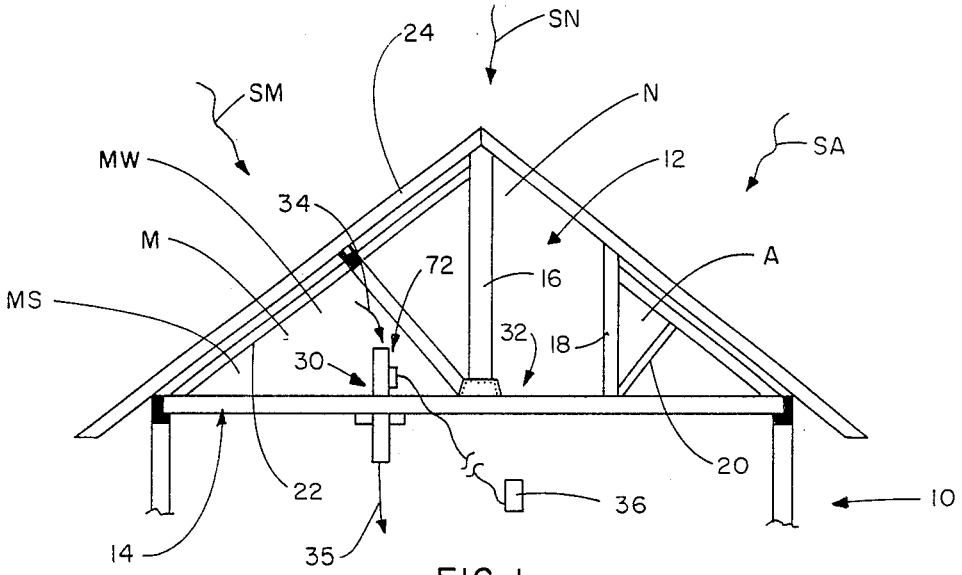
FIG. 1 is an elevational view of a building attic having a single heating system assembly of the present invention.

Shown in FIG. 1 is a building 10 having an attic 12 that is formed by a tie beam system 14 supporting a king post 16, queen posts 18, struts 20 and rafters 22 and 24. The attic is commonly closed and the roof is supported on the rafters. The building is often exposed sunlight as indicated by arrows SM, SN and SA that correspond to the incidence of sunlight on the building roof during the morning hours, the noon hours and the afternoon hours, respectively.

As can be seen, the angle of incidence of the sunlight changes during the day, and, in fact, the angle of incidence will also be affected by the season of the year as well. Thus, the conditions inside the attic are likely to change during the day and during a season. Thus, one area, area M for example, may be hotter than all other areas in the attic in the morning, whereas area N may be hottest at noon, and area A may be hottest during the afternoon hours. Still further, the areas M, N and A may be further subdivided according to the season of the year. For example, area MS may be hotter than area MW in the spring; whereas, area MW may be hotter than area MS during the winter due to the changing angle of the incidence of the sun and the prevailing winds in these two seasons. The insulation and leaks associated with the building may also affect the temperature distribution in the attic, as well as the conditions in the rooms located beneath the attic. Those skilled in the art will understand all of the various factors that can affect the temperature distribution in the attic, and thus, no further discussion will be directed to such conditions and factors. It will only be noted that there are many factors and conditions that can affect and change the temperature distribution and temperature gradients in the attic.

The present invention is intended to account for such changing conditions in order to take maximum advantage of the stored heat energy located in the attic. The building heating system 30 is indicated in FIG. 1 as being located in the floor portion 32 of the attic and extending through such floor portion into the area located subadjacent to the attic. Warm air 34 is drawn into the system 30, and is forced into other areas in the building as indicated by exit arrow 35. The overall system 30 is controlled according to a manually operated control unit 36 that is located inside of the building.

Figure 3:
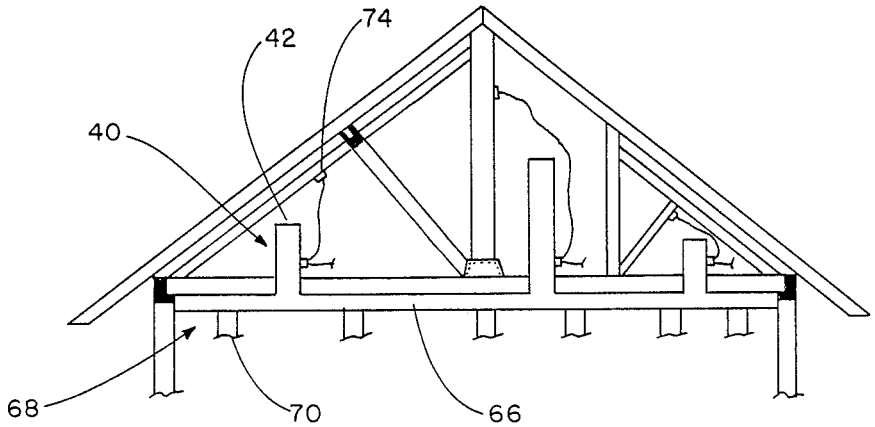
FIG. 3 is an elevational view of a building attic having a plurality of intake ducts located therein.
Figure 4:
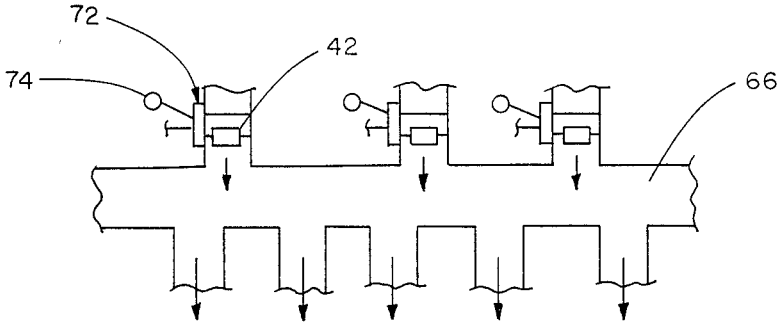
FIG. 4 illustrates the operation of the plural duct system shown in FIG. 3.
Figure 2:
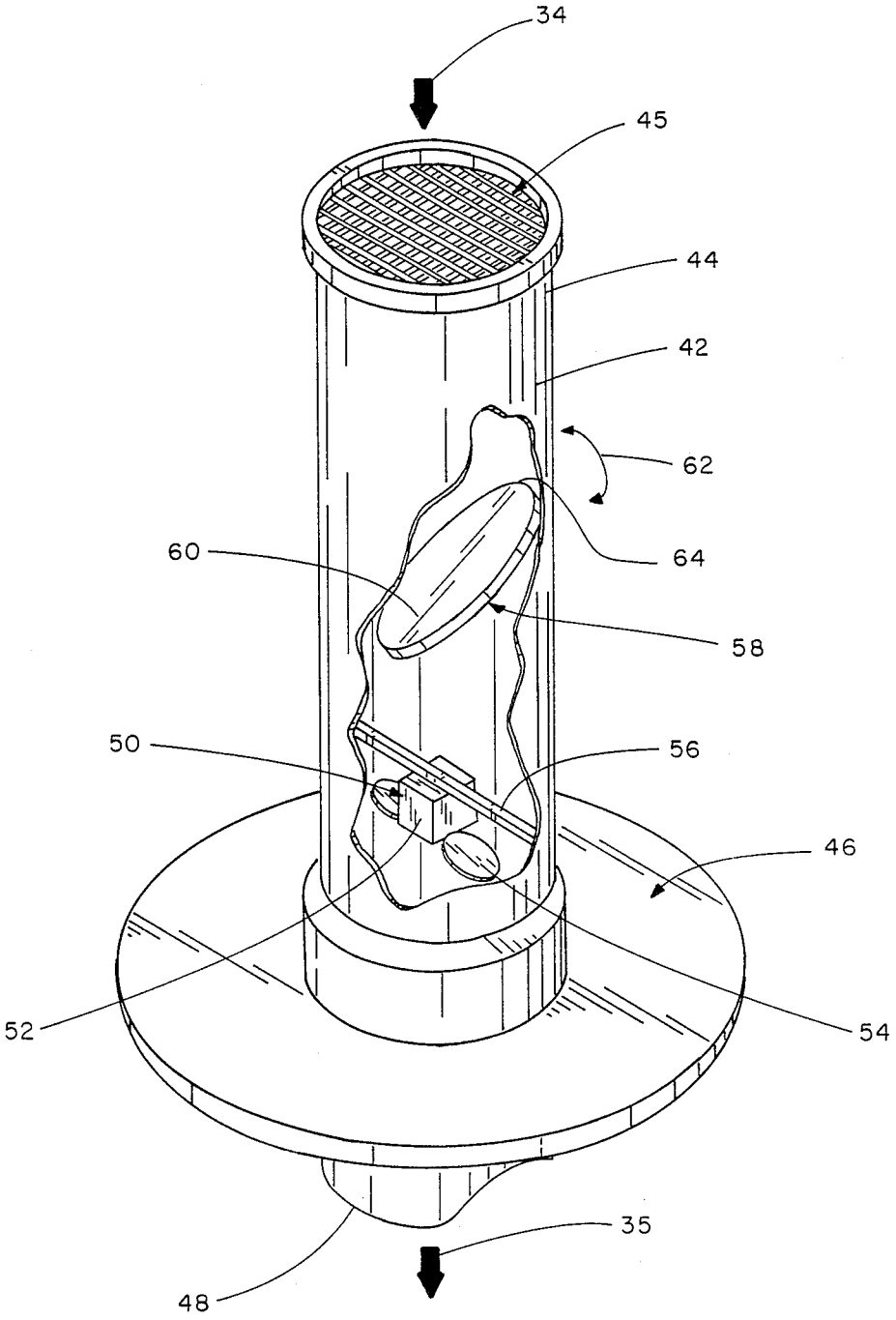
FIG. 2 is a perspective view that has been partically cut away showing an intake duct and an outlet duct of the building heating system.

Referring to FIGS. 2, 3 and 4, the overall system 30 is seen to comprise a warm air inlet system 40 that includes a plurality of inlet ducts 42 that are located in spaced apart positions in the attic, such as in areas A, N, MS, MW and M. The inlet ducts are tubular and hollow and extend from an inlet end 44 having a filter element 45 thereon, through a base flange 46 mounted on the floor of the attic and out beneath that floor to an exit end 48. As indicated in FIG. 2, the ducts can have various lengths to take advantage of conditions in the attic. The filter element 45 is sized to prevent dust and dirt from entering the duct.

Each inlet duct includes a fan unit 50 mounted inside the duct and powered by the same power used by the building. The fan includes a motor unit 52 which drives a blade unit 54 in a direction to draw air into the inlet end of the duct from the attic and move that air through the duct to the outlet end thereof. The fan unit is mounted on a support brace 56 that is affixed to the duct.

An air flow control valve 58 is movably mounted on the duct to be located within that duct. The valve 58 is a butterfly-type valve and is operated by rotating the body 60 thereof in the directions indicated in FIG. 2 by the double-headed arrow 62 by rotating a stem 64 by means of a motor (not shown) mounted on the duct. The orientation of the valve body 60 will determine the amount of air drawn into and through the duct. By operating the valve 58, the temperature of a room can be controlled by controlling the amount of heated air directed thereinto via the heating system.

The exit end of each duct 42 is fluidically connected to a manifold 66 that is pendently attached to a ceiling of the building. Warm air from a particular duct is thus directed into the manifold 66 to be re-directed to the room or rooms of interest. The system thus includeds a warm air outlet system 68 that has a plurality of warm air outlet ducts, such as duct 70, fluidically attached to the manifold to receive warm air from that manifold and direct such warm air into an area within the building.

As discussed above, it has been found to be most energy efficient to use only one duct of the warm air inlet system to draw warm air from the attic. Accordingly, the building heating system 30 includes a control system which selects the duct located nearest to the warmest part of the attic and uses that duct to draw air into the system if that temperature is warm enough to be effective. The effective temperataure is set using the manual control 36, and the amount of air drawn into the duct is controlled according to a demand set on the manual control unit 36 that is conveyed to the fan unit 50 and to the flow control valve 58.

Figure 5:
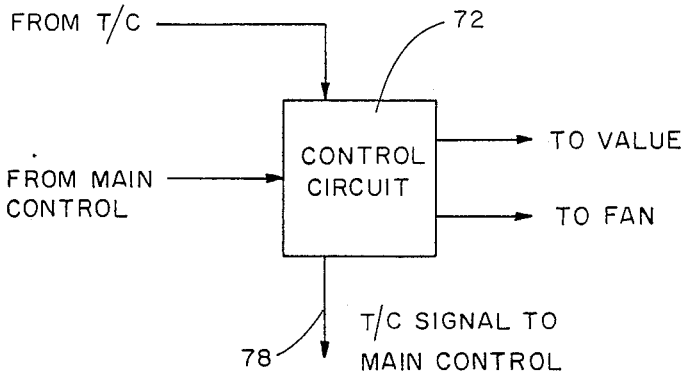
FIG. 5 is a block diagram illlustrating an inlet duct control unit.

As shown in FIGS. 3, 4 and 5, the control system includes an inlet duct control unit 72 mounted on each inlet duct. The control unit 72 includes a control circuit to control the fan and a control circuit to control the valve and is connected to the manual control.

each duct also has a temperature sensing circuit means associated therewith. The temperature sensing circuit means includes a thermocouple, such as thermocouple 74, mounted on a structure located near the inlet duct and generating a temperature dependent signal. That is, the signal generated by the thermocouple changes as the temperature of the attic sensed by the thermocouple changes. This signal is applied to the control unit 72. Thermocouples are well known in the measuring and testing art, and from standard handbooks such as "Handbook of Modern Electronics and Electrical Engineering" edited by Charles Belove and published in 1986 by Wiley Interscience, the disclosure of which is incorporated herein by reference.

Figure 6:
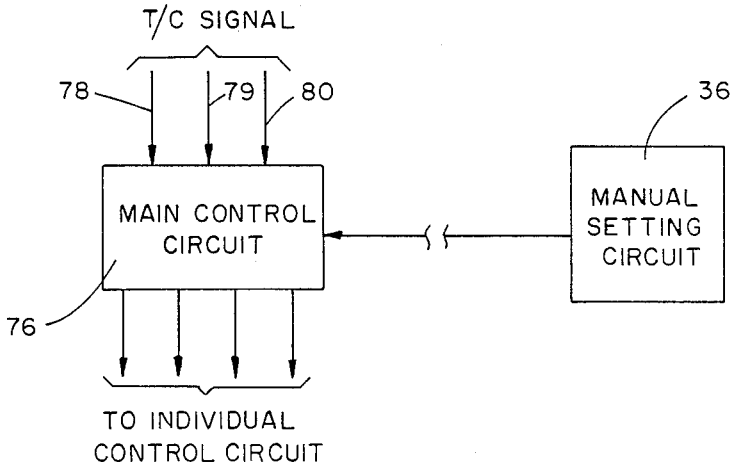
FIG. 6 is a block diagram illustrating the main control circuit means of the plural duct system.
Figure 7:
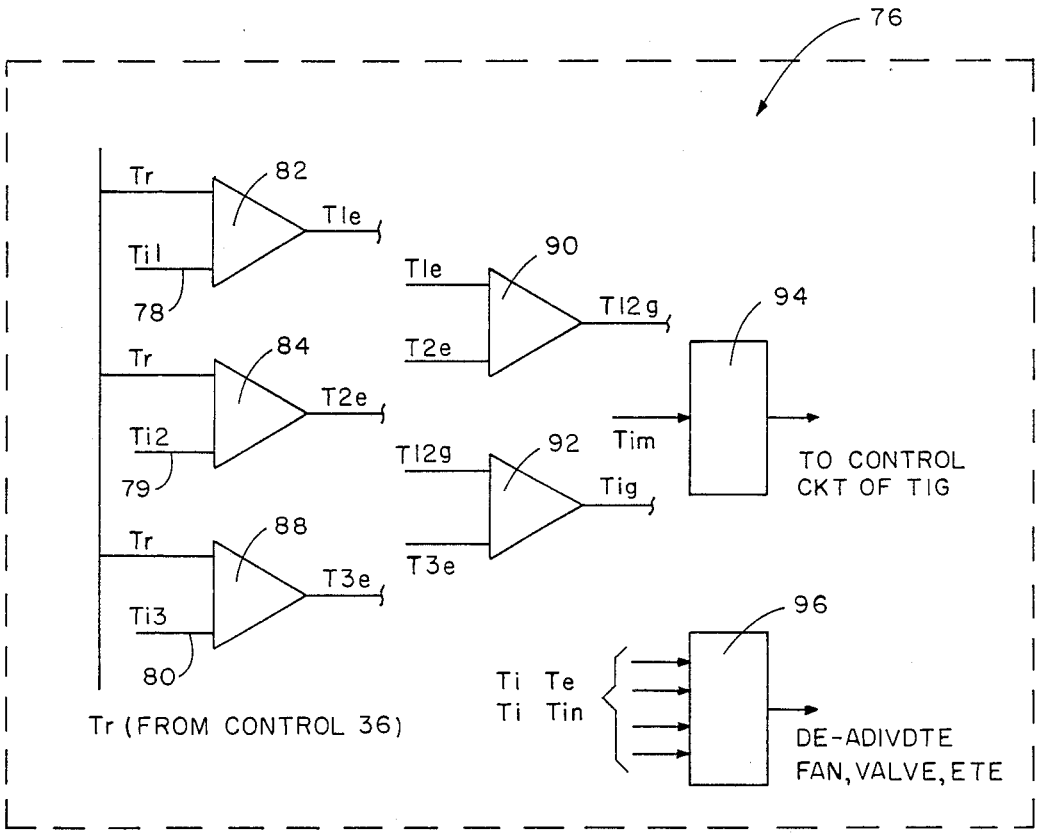
FIG. 7 is a block diagram illustrating the comparator units and the control circuit means included in the main control circuit means.

The control system also includes a main control circuit means which selects the duct that is exposed to the highest temperature to direct heated air into the manifold. This main control circuit means is best shown in FIGS. 6 and 7, and attention is directed thereto. The temperature signals from each of the thermocouples are relayed to a central circuit 76 via line conductors, such as line conductors 78, 79 and 80 connecting the control units 72 to the central circuit 76. Each signal is suitably amplified and conditioned in the control units 72 as is well known to those skilled in the art from texts such as the incorporated handbook. The signals from the thermocouples are applied to comparator elements 82, 84 and 88, which are known to those skilled in the art from texts such as the incorporated handbook as well as standard textbooks such as "Circuits, Devices and Systems" by Ralph J. Smith and published in 1983 by John Wiley & Sons, the disclosure of which is incorporated herein by reference. The signals are compared to a reference signal $T_r$ as set and generated by the manual control unit 36 in each comparator element, and if the temperature signal strength exceeds the reference signal strength, the comparator element produces a signal, such as signals $T_{1e}$, $T_{2e}$, $T_{3e}$, . . . $T_{ie}$, that is applied to a further comparator element, such as a comparator elements 90 and 92 which compare the signals $T_{ie}$ among themselves and to each other, as by comparing signal $T_{1e}$ to signal $T_{2e}$ and selecting the greater of these two signals and generating a signal $T_{12g}$ that is a function of a greater signal, and comparing such greater signal to another signal, such as signal $T_{3e}$, and then selecting the greater of these two signals and comparing it to the next signal and so on until one signal, such as signal $T_{ia}$, is selected that exceeds both the reference signal $T_R$ from the unit 36 and all other signals. This signal $T_{ia}$ is then applied to a controller circuit 94 which suitably amplifies and otherwise conditions this signal and relays such signal to the appropriate control circuit 72 to actuate and control the fan and the flow control valve of that duct associated with the thermocouple generating signal $T_{ia}$. The control of such fan and flow control valve is such as set by the unit 36 to produce the air flow desired for the particular building area or areas. Suitable controller circuits are known to those skilled in the art for sensing the comparator output and controlling operation of the motor unit and the flow control valve. Each comparator element output signal is also applied to a further control circuit 96 that shuts off the motors and valves of any non-selected ducts. In this manner, the circuit 76 senses all of the temperature controlled signals and compares them to the reference signal sent by the controller 36 and to each other and then uses the signal that is associated with the highest temperature to operate the fan and flow control valve associated with the duct located nearest to the thermocouple sensing that highest temperature while de-activating all other fans and flow control valves. This comparison and selection process is continuously carried out, and any time a temperature exceeds the temperature of an operating duct, that operating duct is shut down and the duct associated with the higher temperature is activated. In this manner the duct associated with the highest temperature is always selected so that changing conditions will be accounted for at all times. The comparator elements such as elements 82, 84, 86, 90 and 92, all include suitable comparator op-amps, such as inverting comparator op-amps and non-inverting comparator op-amps as well as other suitable signal conditioning elements.

Figure 8:
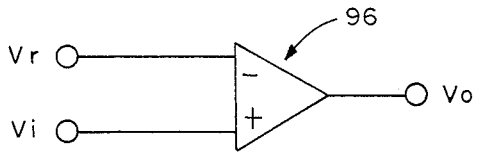
FIG. 8 is a diagram illustrating an inverting comparator operational amplifier used in the main control circuit means.
Figure 9:
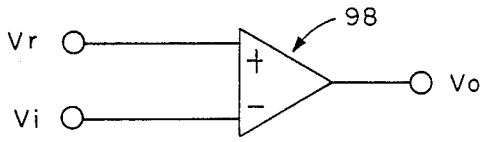
FIG. 9 is a block diagram illustrating a non-inverting comparator operational amplifier used in the main control circuit means.

A suitable inverting comparator 96 is shown in FIG. 8, and a suitable non-inverting comparator 98 is shown in FIG. 9. The non-inverting compartators are used in comparator elements 82, 84. 86, 90 and 92, while the inverting comparators are used in the control circuit 96.

It is understood that while certain forms of the present invention have been illustrated and described herein, it is not to be limited to the specific forms or arrangements of parts described and shown.

I claim:

1. A building heating system which comprises:

(A) a warm air inlet system located in an attic area of a building and including
  (1) a plurality of inlet ducts positioned at spaced apart locations in the attic area and extending through a floor of the attic,
  (2) a fan unit mounted in each inlet duct to draw air from the attic area into each inlet duct when said fan is operated,
  (3) an air flow control valve mounted in each duct to control the amount of air flowing into the duct;

(B) a manifold mounted adjacent to the attic floor and fluidically connected to each inlet duct to receive warm air therefrom;

(C) a warm air outlet system which includes a plurality of warm air outlet ducts positioned at spaced apart locations throughout the building and each fluidically connected to said manifold to receive warm air therefrom; and (D) a control system which includes
  (1) an inlet duct control unit mounted on each inlet duct and including
    (a) a fan unit control circuit means,
    (b) an air flow control valve control circuit means,
    (c) a temperature sensing thermocouple located in the attic and generating a temperature dependent signal, and
    (d) a temperature signal relaying circuit which receives said temperature dependent signal, and
  (2) a main control circuit means which includes
    (a) a circuit means which receives the temperature dependent signal from each thermocouple via said inlet duct control unit temperature signal relaying circuits on each inlet duct, and
    (b) a comparator circuit means which continuously receives all temperature dependant signals and continuously compares each temperature dependant signal to a reference and to other temperature dependant signals and continuously selects a maximum temperature signal that exceeds said reference and also exceeds all other temperatures sensed by the rest of said thermocouples and which signals all of said inlet duct control units to activate one fan and one flow control valve associated with the temperature sensing thermocouple sensing said maximum temperature and shuts off all other fans and flow control valves so that only the fan and valve of that inlet duct associated with the highest temperature in the attic are operated and all other fans and flow control valves are shut off.

2. The building heating system defined in claim 1 wherein said comparator circuit means includes both inverting and non-inverting comparator op-amps.

3. The building heating system defined in claim 2 further including a filter element on each inlet duct.

4. The building heating system defined in claim 3 wherein said main control circuit means further includes a manually operated control element located in the building and connected to said comparator circuit means and is operated manually to set said reference temperature and to control operation of said fans and said flow control valves.

5. The building heating system defined in claim 4 wherein said inlet ducts all have different lengths.

* * * * *